United States Patent [19]

Vermarien

[11] Patent Number: 4,629,303

[45] Date of Patent: Dec. 16, 1986

[54] PHOTOGRAPHIC PROCESSING APPARATUS

[75] Inventor: Ludovicus E. Vermarien, Kontich, Belgium

[73] Assignee: AGFA-Gevaert N.V., Mortsel, Belgium

[21] Appl. No.: 796,721

[22] Filed: Nov. 12, 1985

[30] Foreign Application Priority Data

Nov. 20, 1984 [EP] European Pat. Off. ... EP 84201671.9

[51] Int. Cl.[4] ..... G03D 3/06

[52] U.S. Cl. ..... 354/320; 354/324; 137/454

[58] Field of Search ..... 354/316, 320, 321, 322, 354/324; 137/386, 453, 454

[56] References Cited

U.S. PATENT DOCUMENTS 3,623,503 11/1971 Suzuki et al. ..... 137/454
3,718,155 2/1973 Suzuki et al. ..... 354/321
4,012,753 3/1977 Schmidt ..... 354/321
4,171,716 10/1979 Szabo ..... 354/324
4,518,240 5/1985 Taylor et al. ..... 354/324

FOREIGN PATENT DOCUMENTS 943653 12/1963 United Kingdom ..... 354/324

*Primary Examiner*—A. A. Mathews
*Attorney, Agent, or Firm*—William J. Daniel

[57] ABSTRACT

Photographic processing apparatus with a processing tray for sheets of photographic material, and a container with processing solution, which is mounted in an inverted position on the tray through the intermediary of an appropriate stop which has a first tube through which liquid may flow into the tray, a second tube for the return of the liquid in the container, a third tube for venting which operates as a bird-fountain level control for the processing solution in the tray, and valves for closing said tubes.

9 Claims, 4 Drawing Figures

PHOTOGRAPHIC PROCESSING APPARATUS

Figure 1:
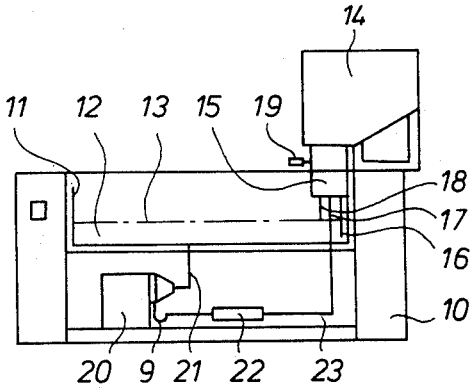

The present invention relates to a photographic processing apparatus with a tray containing a processing solution through which a photographic material is conveyed by appropriate transport means.

Apparatus of the described kind are known comprising a processing tray, a holder for containing a supply of processing solution, pump means for maintaining a circulation of processing solution through said holder and said tray, and means for controlling the level of the liquid in the tray. The holder for containing the supply of processing solution is always arranged below the processing tray, and the pump forces processing solution from the holder upwardly into the tray, where the level control occurs usually by means of an overflow edge, the overflowing liquid returning to the holder.

Apparatus of the described kind are in use on a large scale, in particular in the field of the silver complex diffusion transfer.

One example of suchlike processing apparatus is the COPYRAPID (trade mark of Agfa-Gevaert, Antwerp-/Leverkusen) Offset 0 422 device for the processing of aluminium offset plates according to the silver complex diffusion transfer method.

Some difficulties that are encountered with this kind of apparatus are as follows. The removal of exhausted processing liquid is somewhat difficult, since after all the liquid has been collected in the holder below the tray, liquid conduits to the pump and, as the case may be also to the tray, must be disconnected before the holder can be removed from the apparatus. Further it has been shown that the immersion-type pumps which are generally used for pumping liquid upwardly from the holder, frequently have a limited duration of life. A self-priming pump located higher than the holder at the outside thereof, offers good pumping results in practice but such pumps are more expensive and they conduct due to their construction more heat to the processing liquid than the simple non-selfpriming centrifugal-type pumps, whereby the control of the temperature of the processing liquid may give rise to difficulties.

It is the object of the present invention to provide an apparatus of the kind referred to which is easier to manipulate for the operator and wherein a cheap and reliable non-selfpriming pump may be used for the circulation of the liquid.

According to the present invention, a photographic processing apparatus comprising a tray with means for transporting a photographic material through the tray, a holder for containing a supply of processing solution, pump means for maintaining a circulation of processing solution through said holder and said tray, and means for controlling the level of the liquid in the tray, is characterized thereby that the holder for the processing solution is a disconnectable container which is arranged at a higher level than the one of the liquid in the tray and which is provided with a stop closing a container opening that is turned downwardly as the container is fitted in place on the apparatus, said stop being provided with a first tube through which liquid can flow by gravity from said container into said tray, a second tube through which liquid can be pumped by said pump means upwardly into said container, a third tube extending from a position above that of the liquid in the container downwardly to the desired level of the liquid in the tray thereby to operate as a bird-fountain level control, and cock means by means of which the three tubes extending through the stop can be closed or opened.

The mounting of the holder for containing a supply of processing liquid above the tray permits the use of a simple non-selfpriming pump at a level below that of the tray. The provision of the holder for the processing liquid as a disconnectable container, permits as easy filling of the apparatus since the holder may be in the form of a jerrycan in which the processing liquid is marketed and that may be readily fitted onto the apparatus.

According to a preferred embodiment of the apparatus according to the invention, the three tubes are arranged for control by the stem of one cock which has three distinct control positions, namely a first position wherein the three tubes are closed, a second position wherein the first tube is closed and the other two tubes are opened, and a third position wherein all three tubes are open. This feature allows to pump all the processing liquid of the tray into the container, namely in the second position of the stem, and then to remove the container from the apparatus after the stem has been put in the first position.

The apparatus according to the invention is particularly suited for carrying out the silver complex diffusion transfer process, and even more particularly for making aluminium offset printing plates according to this process.

In the silver complex diffusion transfer process, silver complexes are image-wise transferred by diffusion from a silver halide emulsion layer to an image-receiving layer, where they are converted, optionally in the presence of development nuclei, into a silver image. For this purpose, an image-wise exposed silver halide emulsion layer is developed by means of a developing substance in the presence of a so-called silver halide solvent. In the exposed parts of the silver halide emulsion layer the silver halide is developed to silver so that it cannot dissolve any more and consequently cannot diffuse. In the non-exposed parts of the silver halide emulsion layer the silver halide is converted into soluble silver complexes by means of a silver halide complexing agent (a so-called silver halide solvent) and transferred by diffusion to an adjacent image-receiving layer or to an image-receiving layer brought into contact with the emulsion layer to form, usually in the presence of development nuclei, a silver, or silver-containing image in the image-receiving layer. By the use of a negative silver halide material a positive silver image is obtained in the image receiving material. More details on the DTR-process can be found in "Photographic Silver Halide Diffusion Processes" by A. Rott and E. Weyde, Focal Press, London, New York (1972).In case the image-receiving material is an aluminium foil, the processing permits to produce a high quality printing plate within a few minutes.

Figure 2:
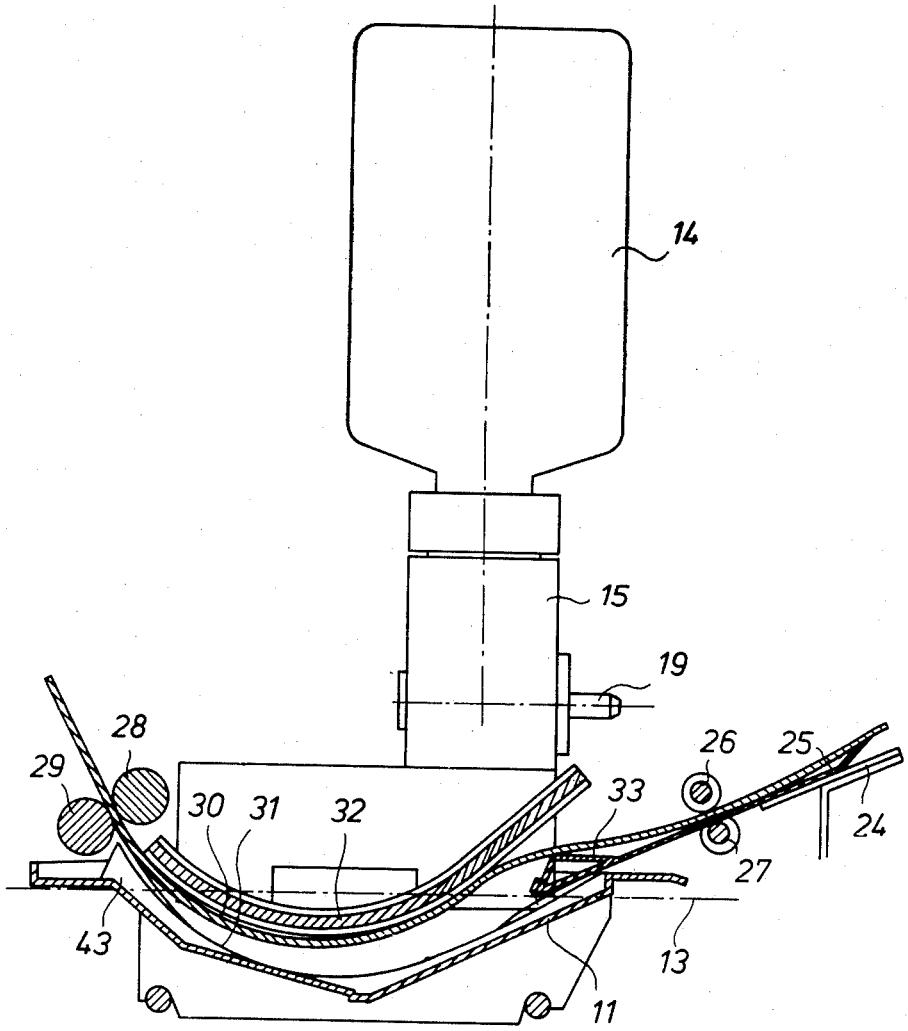
Figure 3:
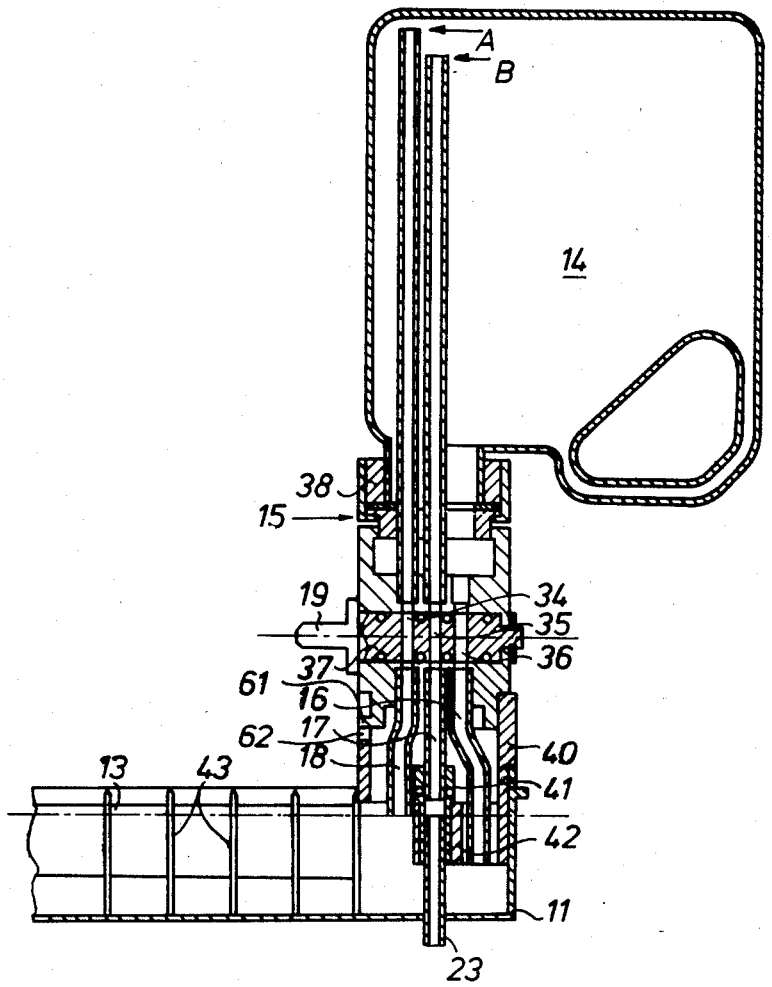
Figure 4:
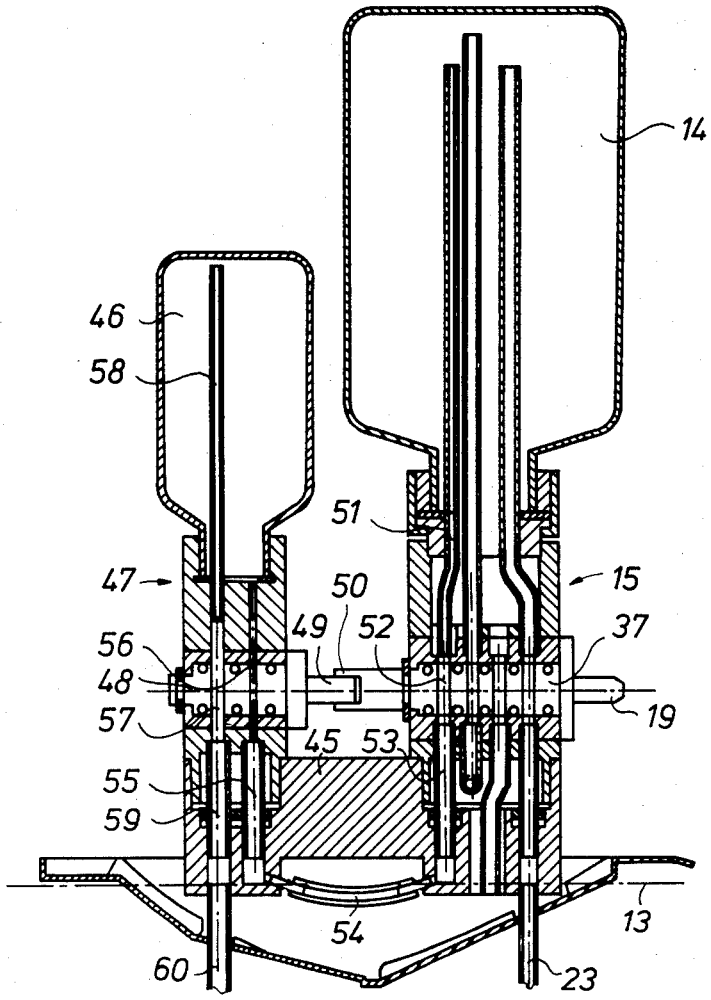

The invention is described hereinafter by way of example with reference to the accompanying drawings wherein:

FIG. 1 is a diagrammatic longitudinal sectional view of one embodiment of an apparatus according to the invention, FIG. 2 is a transverse sectional view of the apparatus according to FIG. 1, FIG. 3 is a detailed sectional view of the fitting of the container onto the processing tray of the apparatus, and FIG. 4 is a modified embodiment of the apparatus according to FIGS. 1 to 3.

Referring to the diagrammatic drawing of FIG. 1, the apparatus comprises a housing generally designated by 10. A processing tray 11 contains processing solution 12 which is maintained to a level 13.

A plastic jerrycan 14 which contains a supply of processing solution is mounted in an inverted position onto the apparatus. The usual screw closure cap of the jerrycan has been replaced by a stop 15 which is provided with three tubes 16, 17 and 18 passing through it and a knob 19 for controlling a stem with appropriate bores for opening or closing the tubes.

The tube 16 is a conduit through which liquid can flow by gravity from the container into the tray. The tube 17 is a conduit through which processing liquid is pumped upwardly into the jerrycan, and the tube 18 is a tube that controls the level 13 of the processing liquid in the tray according to the so-called bird-fountain principle. Finally, the apparatus comprises a centrifugal type pump 20 that pumps liquid that is withdrawn from the tray through a flexible hose 21, to the tube 17 via a heater element 22 and a conduit 23. The heater element 22 is thermostatically controlled in a known way, to keep the temperature of the processing solution at a desired value.

FIG. 2 illustrates a transverse sectional view of the apparatus according to FIG. 1. The entry end of the apparatus is provided with an inclined feed table 24, a sheet separator plate 25, and a pair of inlet feed rollers 26, 27. The outlet end of the apparatus is provided with a pair of outlet rollers 28, 29. The inlet and outlet rollers are driven in a usual way by motor means, not illustrated in the drawings. The negative sheet is indicated by 30, whereas 31 is the aluminium plate. A curved top plate 32 controls, together with the angled end portion 33 of plate 25, the path of the negative sheet 30 through the tray 11. The aluminium plate slides over ribs 43 on the bottom plate of the tray.

FIG. 3 shows a detailed sectional view of the stop 15 that ensures the connection between the jerrycan 14 and the apparatus. The stop comprises the three tubes 16, 17 and 18, the functions of which have already been described. The tube 18, which is the level control, extends up to the highest position, indicated by A, in the jerrycan. Said position is in any way above the level of the liquid in the jerrycan, also in case the jerrycan is a fresh, completely filled one. The position of the upper end B of the tube 17 is situated slightly lower.

The stop 15 is provided with a cock with a cylindrical stem 37 that has three radial bores 34, 35 and 36. Rotation of the stem is controlled by knob 19. The drawing shows the third operative position of the stem, namely the one wherein the three bores 34, 35 and 36 take an open position. In the first position of the stem the three bores take a closed position, whereas in the second angular position of the stem the bore 36 of the outlet tube 16 takes a closed position while the two other bores take open positions for the corresponding tubes.

The stop 15 is fitted onto the jerrycan 14 by outer means of a collar 38 that has an inner screw thread which fits on the screw thread of the jerrycan neck. The collar 38 is rotatable with respect to the body of the stop 15 so that, even when the collar 38 is tightly screwed on the jerrycan, the jerrycan may yet be turned on the stop 15 in order to obtain an angular position of the jerrycan on the apparatus wherein the handle of the jerrycan does not interfere with the apparatus, in the present case a position outside of the apparatus, as illustrated.

The lower end of the stop 15 fits onto a seat in the form of a short upstanding tube 40. An outer rib 61 of the stop 15 engages with a corresponding slot 62 of the tube 40, so that the angular position of the stop in the seat is secured. The jerrycan may rest with the handle on the top of the apparatus.

The level controlling tube 18 extends freely within the inner space of the seat 40. The filling tube 17 fits into a tube end 41 which is fixedly mounted in the seat 40 by means of a small support 42. Although an O-ring in the tube end 41 ensures the liquid-tight sealing with the tube 17, this sealing is not critical and liquid that leaks occasionally from said seal simply flows back into the body of liquid in the processing tray 11. The tube end 41 is in connection with the pump 20 through the hose 23. The outlet tube 16 extends likewise freely within the seat element 40, and the lower end thereof is situated preferably below level 13 of the liquid in the tray. The ribs 43 in the tray 11 reduce the frictional contact with the rearside of the aluminium plate, see also FIG. 2.

The operation of the described apparatus is as follows. The operator takes a jerrycan with fresh processing solution as supplied by the manufacturer of the apparatus or the supplier of processing solutions, and he removes the original closure cap and destroys the induction sealing of the container neck. The operator screws the stop 15 on the jerrycan and, the tubes 16, 17 and 18 being closed, he inverts the jerrycan and fits it by means of the stop 15 on the seat 40 of the processing apparatus.

Then the cock of the stop 15 is opened whereby processing liquid flows into the tray and the pump circuit until a liquid level 13 is reached in the tray 11. Up from this liquid height the lower end of the tube 18 becomes closed by the liquid, so that air cannot enter any longer in the jerrycan and an underpressure develops in the jerrycan which prevents further liquid flow.

Then the electric circuitry of the apparatus can be switched on whereby the transport rollers and the pump 20 start to rotate, and the heater element 22 becomes energized. After some time the set processing temperature of the processing solution is attained, whereafter the apparatus is ready for use.

An aluminium sheet is taken and placed with its anodized side upwardly on the table 24, and an image-wise exposed light-sensitive sheet 30 is placed on the separator plate 25 in appropriate relationship with the aluminium sheet. Both sheets are then manually advanced until the sheet transport rollers take over the sheet transport. The sheets are transported through the processing solution and firmly urged onto each other by the rollers 28, 29 so that up from that moment the diffusion transfer starts. After some tens of seconds the sheets may be peeled apart and the aluminium plate is ready for offset printing. In the meantime, processing solution is continuously carried off from the tray by the pump 20, and as the level of the liquid in the tray tends to become lower, air is continuously admitted into the jerrycan 14 through the tube 18 whereby liquid flows from the jerrycan into the tray through the tube 16, whereby the level of the processing liquid in the tray remains constant.

When the apparatus must be emptied for cleaning purposes, or when the apparatus has to remain for a longer time inoperative, all the processing liquid is pumped from the tray into the jerrycan. To this end, the knob 19 of the cock 15 is turned in an intermediate position in which the tube 16 is closed but the tubes 17 and 18 remain open, so that the pump 20 gradually displaces all the liquid from the tray 11 towards the jerrycan. The knob 19 may then be turned in the "closed" position wherein the jerrycan may be removed from the apparatus.

It will be understood that a small amount of processing liquid remains in the heater 22, the hose 23, the pump 20, etc. It may therefore be desirable to provide a small drain valve at the lowest point of the liquid circuit, for instance on the drain point 9, see FIG. 1, so that also the remaining liquid may be carried off before the hoses 21 and 23 are disconnected in view of the removal of the tray from the apparatus.

In the apparatus described hereinbefore, there is no provision to compensate for the exhaustion of the processing solution as a consequence of the number of processed sheets. In case the exhaustion of the processing solution has an adverse effect on the processed image, the apparatus may be provided with a regeneration system that adds regeneration liquid to the processing solution in an amount that is proportional with the amount of processed material.

One embodiment of a suitable regeneration system is illustrated in FIG. 4.

Referring to FIG. 4 which shows a modified embodiment of the apparatus according to the invention, the apparatus is provided with a seat 45 onto which may fit a supply jerrycan 14 with its appropriate stop 15, and an inverted bottle 46 with regenerating liquid, with its corresponding stop 47. The stem 48 of the cock of stop 47 is in engagement with the stem 37 of the stop 15, through a corresponding lip-and-slot engagement 49, 50.

The stop 15 is provided with an additional tube 51 which communicates through an additional bore 52 in the stem with the tube section 53. The bore 52 takes an open position as the other bores are open, and is closed in both other positions of the stem 37.

The tube section 53 communicates through a short conduit 54 with the tube section 55 of the stop 47. The section 55 may be brought in connection with the bottle 46 through a bore 56 in the stem 48. A second bore 57 in the stem permits to establish the communication between a tube 58 that extends upwardly in the bottle, and a tube 59 that is in communication with a conduit 60 through which pressurized air may be forced in the bottle 46. The stop 47 rests in a seat of the member 45 in a way similar to the fitting of the stop 15, and the tubes 55 and 59 tightly fit into corresponding openings of the member 45 through appropriate seal rings.

The operation of regeneration is as follows. The apparatus is provided with a small air-pressure pump, an electromagnetic valve in the conduit 60 leading from the pump to the tube 59, and a sensor circuit that measures the amount of photographic material processed in the apparatus. These components are conventional in the art and have therefore not been illustrated in the drawing. As a predetermined amount of material has been processed, the sensor circuit controls the valve to admit for some seconds air-pressure in the bottle 46. The reduction of underpressure caused thereby in the bottle 46 causes regeneration liquid to flow from the bottle 46 towards the jerrycan 14 through the connection 54, until the underpressure in the bottle 46 is again in equilibrium with that in the can 14. The underpressure in the jerrycan 14 is determined, as mentioned already hereinbefore, by the bird-fountain control of the level of the processing liquid in the tray.

When the bottle or the jerrycan must be removed from the apparatus, the openings of both stops 15 and 47 are closed so that the slot 50 of the stem 37 takes a vertical position. This position enables the independent removal of either the bottle 46 or the jerrycan 14 with the corresponding stop from the seat 45.

The invention is not limited to the described embodiments.

The rotations of the transport rollers and of the pump need not necessarily occur simultaneously as described hereinbefore. In principle, the pump may be started up from the moment there is processing liquid in the pumphousing.

The transport rollers may be started also after the two sheets have been appropriately positioned at the entry end of the apparatus. In this way the lower sheet may for instance be made to abut in the nip of the entry rollers, and the upper sheet may then be placed on the guide plate with an appropriate spacing of its leading edge from the leading edge of the lower sheet. Then the transport rollers are started to advance the sheets through the apparatus.

According to another embodiment, also known in the art, the inlet rollers may be arranged for taking an open position wherein the sheets may be freely slid between the rollers until they abut with their leading edges against a stop that is provided on their path above the liquid level in the tray. In this way the desired relation positions of both sheets may easily be obtained. Then the inlet rollers are closed to engage the sheets, the stops are removed from the sheet paths, and the rollers are driven to transport the sheets through the apparatus.

The apparatus according to the invention may also be used for the processing of single photographic materials according to the common development, fixing and rinsing process, or according to the so-called activation and stabilisation process. The apparatus may comprise more than one tray which is in communication with the holder for the supply of processing solution. The container for the processing solution may have the form of a jerrycan or a cylindrical bottle as mentioned already, but it may as well have a mantle of a polygonal shape, it may be of mixed composition, e.g. partly metal, partly plastic, it may occasionally be collapsible, etc.

I claim:

1. Photographic processing apparatus comprising a tray with means for transporting a photographic material through the tray, a holder for containing a supply of processing solution, pump means for maintaining a circulation of processing solution between said holder and said tray, and means for controlling the level of the liquid in the tray, characterized in that the holder for the processing solution is a disconnectable container which is arranged at a higher level than the one of the liquid in the tray and which is provided with a stop for closing a container opening that is turned downwardly as the container is fitted in place on the apparatus, said stop being provided with a first tube through which liquid can flow by gravity from said container into said tray, a second tube through which liquid can be pumped by said pump means upwardly into said container, a third tube extending downwardly from a position above that of the liquid in the container to the desired level of the liquid in the tray thereby to operate as a bird-fountain level control, and cock means by means of which the three tubes extending through the stop can be closed or opened.

2. Photographic processing apparatus according to claim 1, wherein said cock means is arranged for control by a stem which has three distinct control positions, namely a first position wherein the three tubes are closed, a second position wherein the first tube is closed and the other two tubes are opened, and a third position wherein all three tubes are open.

3. Photographic processing apparatus according to claim 1, wherein said stop of said container is arranged for co-operation with a seat of the apparatus for supporting said container.

4. Photographic processing apparatus according to claim 1, wherein said second tube is arranged for connection to the outlet end of a tube through which the liquid is pumped upwardly from the tray.

5. Photographic processing apparatus according to claim 1, wherein said stop is screwed onto the pouring opening of the container in the place of the usual closure cap for the container.

6. Photographic processing apparatus according to claim 1, wherein said stop is provided with a fourth tube through which regeneration liquid may be added to the liquid supply.

7. Photographic processing apparatus according to claim 1, wherein said pump is a centrifugal-type pump.

8. Photographic processing apparatus according to claim 1, which comprises a holder for regeneration liquid, said holder being likewise mounted in inverted position on the apparatus through the intermediary of an appropriate stop with valves for closing a liquid outlet opening and an air-pressure inlet opening.

9. Photographic processing apparatus according to claim 1, wherein the valves of the stop of said container for processing solution are coupled with the valve of the stop of said holder for regeneration liquid.

* * * * *